US006863125B2

(12) United States Patent
Ivannikov et al.

(10) Patent No.: US 6,863,125 B2
(45) Date of Patent: Mar. 8, 2005

(54) DEVICE FOR FLOW AND LIFTGAS PRODUCTION OF OIL-WELLS (VERSIONS)

(75) Inventors: Vladimir Ivanovich Ivannikov, Moscow (RU); Ivan Vladimirovich Ivannikov, Moscow (RU)

(73) Assignee: Bip Technology Ltd., Limassol (CY)

( * ) Notice: Subject to any disclaimer, the term of this patent is extended or adjusted under 35 U.S.C. 154(b) by 61 days.

(21) Appl. No.: 10/240,892

(22) PCT Filed: Mar. 11, 2001

(86) PCT No.: PCT/RU01/00102

§ 371 (c)(1),
(2), (4) Date: Oct. 4, 2002

(87) PCT Pub. No.: WO01/79656

PCT Pub. Date: Oct. 25, 2001

(65) Prior Publication Data

US 2003/0094283 A1 May 22, 2003

(30) Foreign Application Priority Data

Apr. 7, 2000 (RU) ..... 2000108540
Dec. 15, 2000 (RU) ..... 2000131378

(51) Int. Cl.[7] ..... E21B 43/36
(52) U.S. Cl. ..... 166/105.5; 166/177.6; 166/177.7; 166/265
(58) Field of Search ..... 166/265, 372, 166/105.5, 177.6, 177.7

(56) References Cited

U.S. PATENT DOCUMENTS 5,431,228 A 7/1995 Weingarten et al.
6,293,340 B1 * 9/2001 Wu ..... 166/105.5

FOREIGN PATENT DOCUMENTS

RU 1117395 10/1984
RU 2029073 2/1995
RU 2122106 11/1998
RU 2129208 4/1999

OTHER PUBLICATIONS

I.M. Muraviev and A.P. Krylov, "Exploitation of oil deposits", Gostoptekhizdat, M., 1949, (pp. 448–460).

* cited by examiner

*Primary Examiner*—William Neuder

(57) ABSTRACT

The proposed device for operation of free flowing and gas lift oil wells relates to production of gas-liquid mixtures, and particularly of gasified oil, and can be used in wells if either the productive formation flows naturally or when compressed gas is artificially supplied to lift the liquid (i.e. gas lift production) and can be made in two embodiments.

In first embodiments of the device for operation of free flowing and gas lift oil wells a device for modifying of a gas-liquid flow structure is placed inside a lift tubing string employed to lift the liquid and gas, which device is made in form of, at least, one float ball valve where radius and weight of the ball are selected depending on speed of the gas-liquid flow and diameter of the ball 0.8–0.9 of inner diameter of tubes of the lift tubing string.

In another embodiment a device for modifying of a structure of a gas-liquid flow placed inside a lift tubing string is made in a form of, at least, one element to form a gas-liquid flow structure—a bead that have size ratio of $d_S/d_T \leqq 0.9$, where $d_S$—diameter of maximum cross-section of the bead, $d_T$—inner diameter of the lift tubing string, and the bead is stringed on the support in the form of a wireline or rod assembly and placed along the lift tubing string with opportunity of radial and axial motion. And the axial motion of the beads is admitted only within intervals between the stoppers that are fixed on the suspension support with spacing intervals between them selected depending on a current level of gas content along the lift tubing string. And the beads can be made of different geometrical shapes and from materials with the same or different specific gravity or different materials, and either solid or hollow or with a hollow filled with liquids of same or different gravity.

7 Claims, 6 Drawing Sheets

DEVICE FOR FLOW AND LIFTGAS PRODUCTION OF OIL-WELLS (VERSIONS)

CROSS REFERENCE TO RELATED APPLICATIONS

Applicants claim priority under 35 U.S.C. §119 of Russian Application Nos. 2000108540 and 2000131378 filed Apr. 7, 2000 and Dec. 15, 2000, respectively. Applicants also claim priority under 35 U.S.C. §365 of PCT/RU01/00102 filed Mar. 11, 2001. The international application under PCT article 21(2) was not published in English.

FIELD OF USE

The proposed invention relates to production of gas-liquid mixtures, and particularly of the gasified oil, and can be used in wells in case when productive formation naturally flows or in case of artificial injection of compressed gas to lift the liquid (gaslift production).

PRIOR ART

A device is known for periodic operation of well using compressed air [1] (I. M. Muraviev and A. P. Krylov, "Exploitation of oil deposits", Gostoptekhizdat, M., 1949, pp. 448–460) commonly referred as a free plunger lift. The plunger appears to be a hollow cylinder with an automatic valve at its lower end. The plunger and lift tubing form a piston-cylinder system. When it moves down the valve opens and the plunger drops due to its weight. When it moves up the valve closes and the plunger lifts due to pressure of gas releasing from the formation or gas supplied into the well. Thus the piston-cylinder expelling of oil takes place along the whole length of the lift tubing.

One can refer the following general shortcomings of this device:

1. Complicated surface equipment;
2. Complicated design of the plunger;
3. Insufficient productive capacity because of an idle run when the plunger goes down (from mouth of the well to bottom hole);
4. High gas losses during lifting the liquid.

A device is also known [2] (USSR Certificate of Authorship no. 1117395, 07.10.1984) for periodic gaslift production of liquid from wells and used for operation of free flowing or gaslift oil wells. It comprises a tubing string and a displacement chamber placed inside the lift tubing in which chamber a periodic gas-liquid structure is formed (alternating of liquid and gas slugs). Number of the displacement chambers to be installed in various sites along the lift tubing can vary.

This device is the most relevant to the proposed by its working principle and therefore it was selected as a prototype.

General shortcomings of the prototype are as follows:

1. Elements forming the gas-liquid flow structure are installed stationary at the pipe joints of a lift tubing string and, therefore, to replace them the lift tubing string to be pulled out and then run into the well again;
2. An effect of vibrational action on the lift column is not provided to accelerate draining of liquid along tubing wall when forming the liquid slugs and preventing growth of salt or hydrate or paraffin deposits inside the lift tubing;
3. No opportunity is provided to clean the lift tubing from said deposits;
4. No opportunity is provided to deliver instrumentation into the lift tubing to measure the bottom hole parameters of the rock fluid inflow and carry out the well logging.

DESCRIPTION OF THE INVENTION

In the proposed inventions a task is solved to improve effectiveness of production of a liquid phase of the rock fluids, to reduce emission of oil or working gas along with the simultaneous getting rid of the mentioned above shortcomings inherent to the devices known from the prior art that are also intended to form a certain structure of the gas-liquid flow in wells, and to increase the efficiency of lifting of liquid from wells.

In first embodiments of the device for operation of free flowing or gaslift oil wells a device to modify a structure of gas-liquid flow is placed inside a lift tubing string employed to lift the liquid and gas, which device is made in form of, at least, one float ball valve where radius and weight of the ball are selected depending on speed of the gas-liquid flow in accordance with the following formulas:

$$V \geq \sqrt{\frac{R(\rho-\rho_M)g}{3\rho_M\left\{\ln\left[\frac{1}{1-\left(\frac{R}{R_T}\right)^2}\right]-\frac{R^2}{R_T^2}\right\}}},$$

$$G=\frac{4}{3}\cdot\pi R^3(\rho-\rho_M)\cdot g=F$$

where

V—speed of gas-liquid flow;

G—weight of a ball;

F—flow drive force;

R—radius of a ball;

ρ—specific gravity of a ball;

$\rho_M$—specific gravity of gas-liquid mixture;

g—acceleration of gravity;

$R_T$—inner radius of tubes of a lift tubing string.

The optimal ratio d of radius of the ball valve R to inner diameter of tubes of the lift tubing string $R_T$ constitutes $$\frac{R}{R_T}\approx 0.8-0.9.$$

In another embodiment of the invention a device to modify a structure of a gas-liquid flow is placed inside a lift tubing string employed to lift the liquid and gas which device comprises, at least, one element to form a structure of the gas-liquid flow made in form of a working body—a bead that have size ratio of $R_S/R_T \leqq 0.9$, where $R_S$—radius of maximal cross-section of the bead, $R_T$—inner radius of the lift tubing string, and which is stringed on the support in the form of a wireline or rod assembly and placed along the lift tubing string with opportunity of radial and axial motion. And the axial motion of the beads is admitted only within intervals between the stoppers. The stoppers of axial motion are fastened on the suspension support with spacing intervals between them determined from a current level of gas content along the lift tubing string. And the beads can be made of different geometrical shapes and from materials with the same or different specific gravity or different materials, and either solid or hollow or with a hollow filled with the liquids of same or different gravity.

BRIEF DESCRIPTION OF DRAWINGS

First embodiment of the device is shown in the FIGS. 1–4.

At the gap spacing in pipe joints (2) of the tubing string (1) a seat (3) is rigidly fasten and above it a ball (4) is placed freely. And the ball (4) has a diameter less than inner diameter of the lift tubing string (1).

Figure 1:
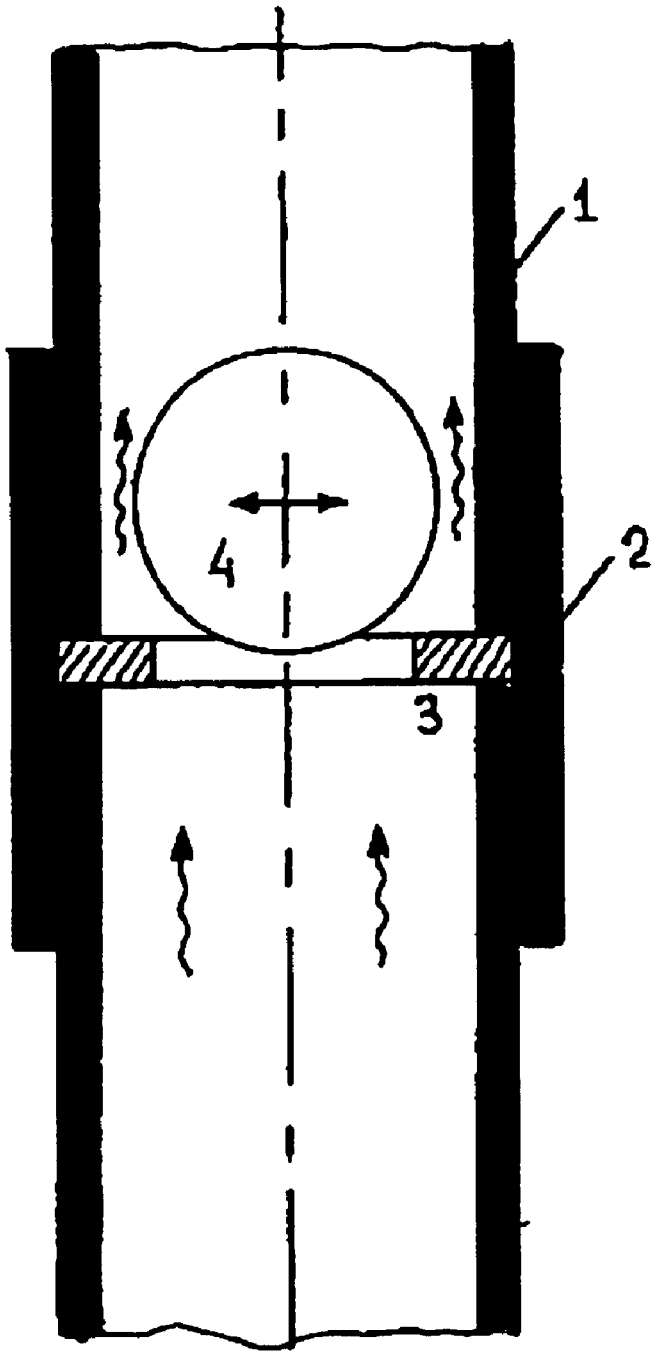
FIG. 1 shows a placement of the float ball valve in the lift tubing string.
Figure 2:
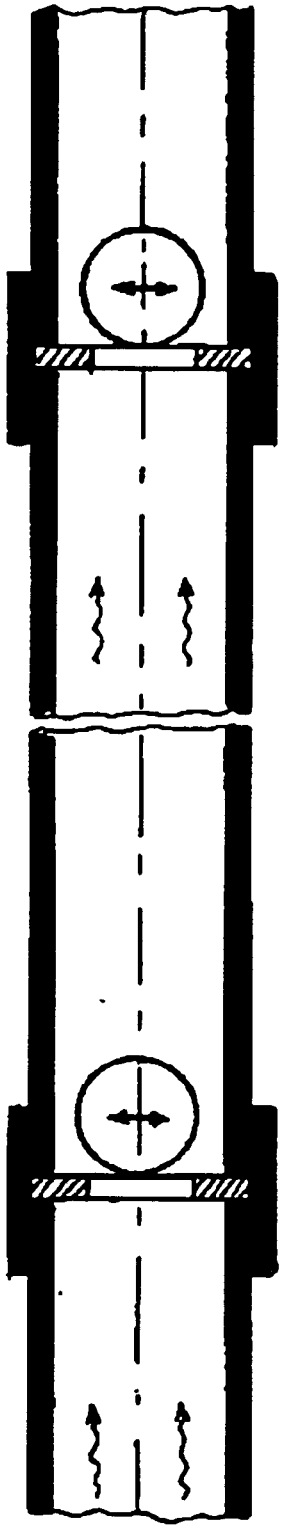

FIG. 2 shows a placement of several devices to modify structure of a gas-liquid flow in the lift tubing string which devices are made in form of the float ball valves.

Figure 3:
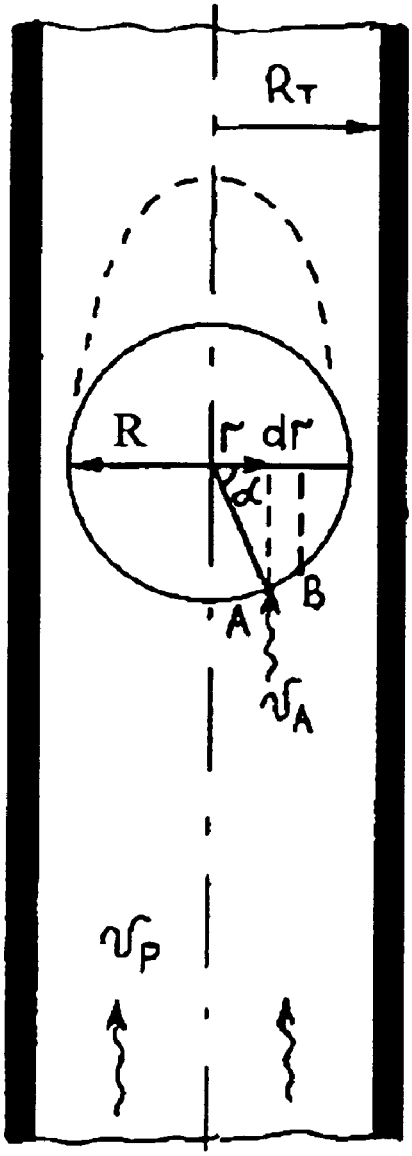

FIG. 3 shows position of the ball in the pipe due to hit of liquid on the ball and partly transferring to it of the liquid flow momentum to illustrate deriving of equations of the ball motion.

Figure 4:
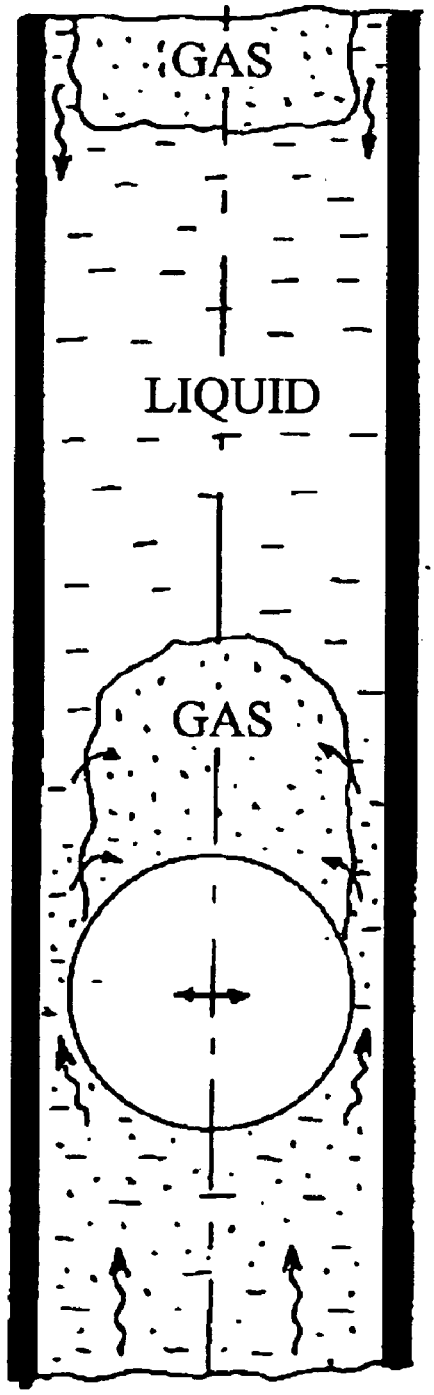

FIG. 4 illustrates forming of the decompression cavity enabling formation of a gas piston (gas slug).

Figure 5:
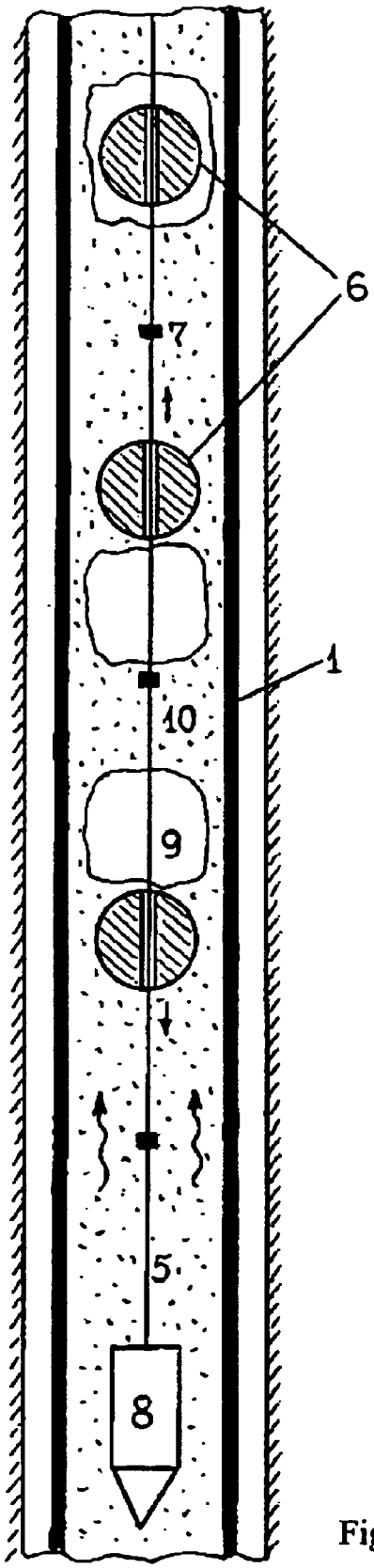
Figure 6:
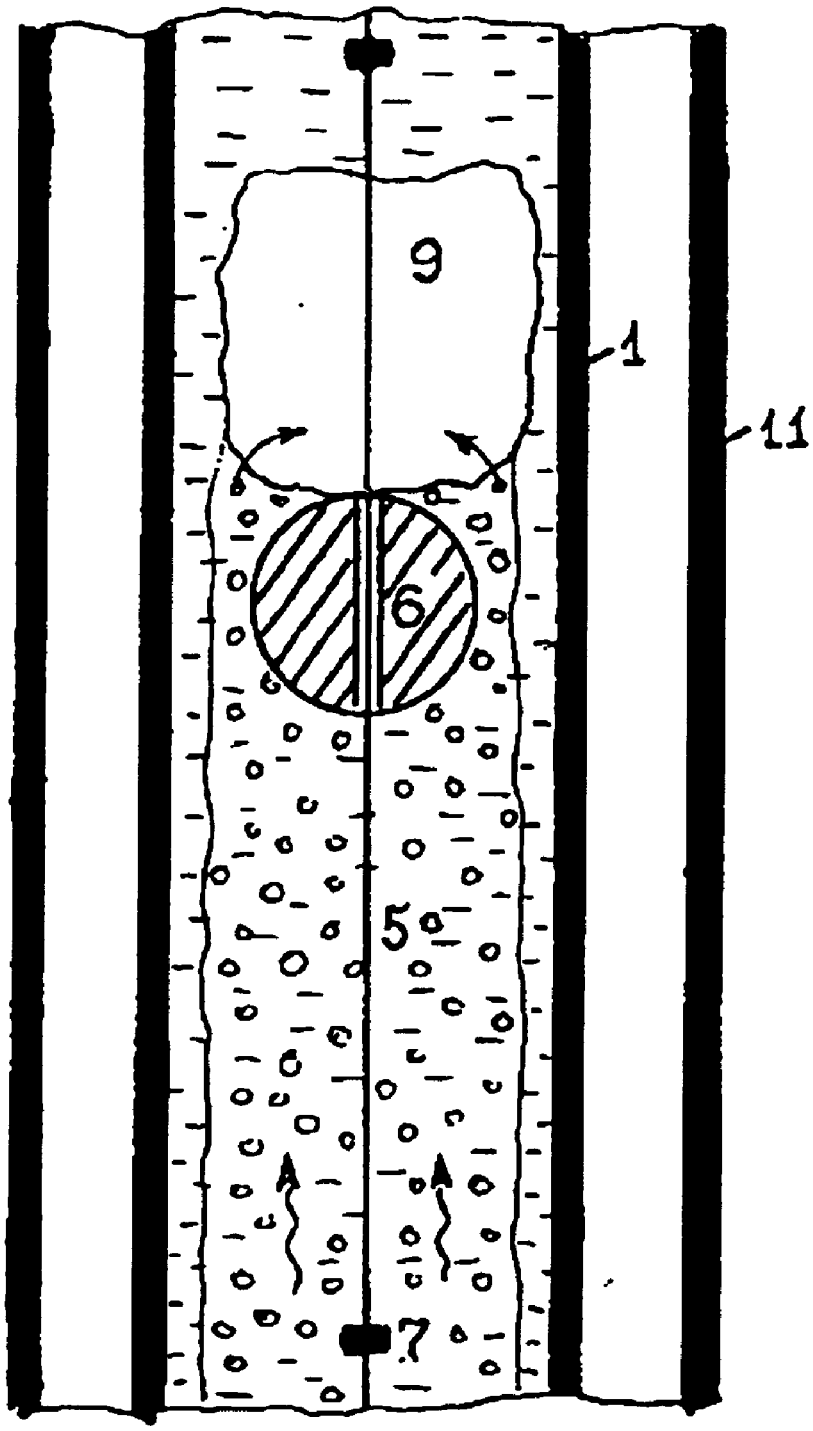
Figure 7:
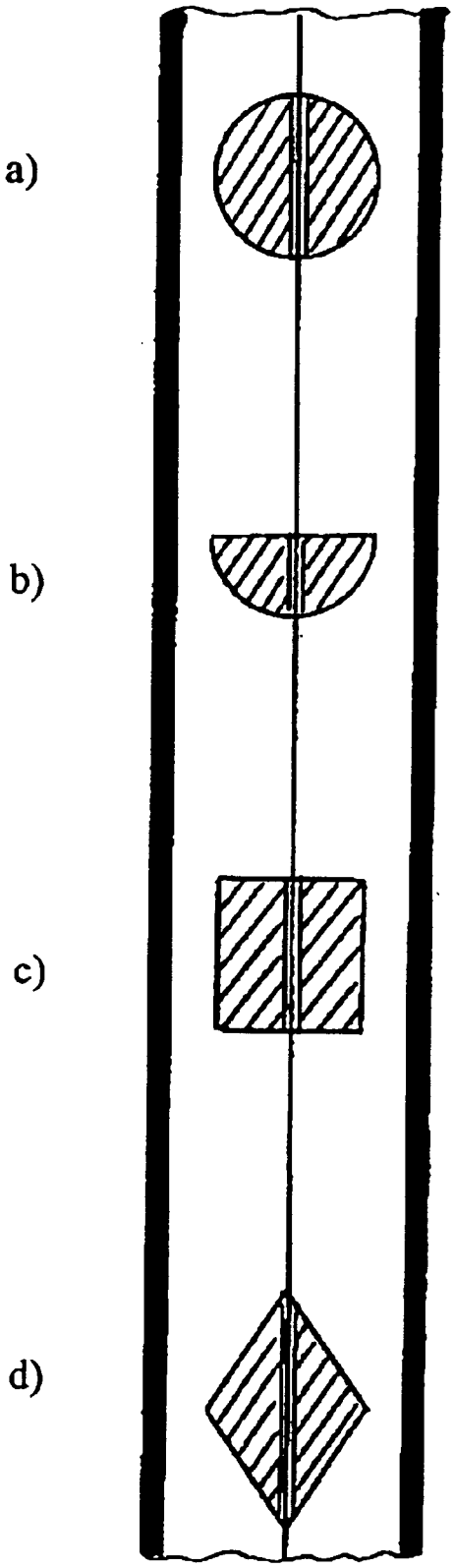

Another embodiment of the device is shown in the FIGS. 5–7.

FIG. 5 shows a general view of placement of a suspension support (5) in the tubing string (1). The suspension support (5) contains elements to form a structure of a gas-liquid flow in form of spherical beads (6) stringed on the suspension support (5) and stoppers (7) in the form of collar rigidly fastened on the suspension support (5) which support has at its lower end an anchor (8). This FIG. 5 shows the gas slugs—bubbles (9) formed during operation of the device and also the liquid, for example, the oil draining down along the tubing wall (1) thus forming the liquid slugs (10).

FIG. 6 shows a placement in the lift tubing string (1) that is set in the well (11) of one working element—a bead (6) in form of a ball. The bead (6) is freely stringed on the suspension support (5) and the stoppers (7) of axial motion of the bead (6) are rigidly coupled with the suspension support (5).

In the FIG. 7 the variants of the beads (6) of various geometrical shapes are illustrated (a, b, c, d).

FIRST EMBODIMENT OF THE INVENTION

First embodiment of the proposed device works as follows. In the lift tubing string and above the bubble point (releasing of gas into a free phase) depth a device to modify a structure of the gas-liquid flow is installed made in form of, at least, one float ball valve. Due to hydraulic head the gas-liquid flow lifts the ball (4) and keep it suspended from the seat (3) since part of the flow flows around in the annular gap between the ball and the tubing wall. And the ball is in non-equilibrium position and transversely oscillates, and due to hits these oscillations are transferred to the tubing (1).

In the tubing of radius $R_T$ and at a distance from the ball the flow runs with the speed $V_p$. Due to liquid hitting the ball and partially transferring of the flow momentum to it the motion of the ball is possible with some constant speed $V_b$. Ignoring the inner friction of liquid, one can admit that behind the ball a decompression zone is formed and therefore the hydrodynamic force doesn't act on it from this side.

Let use a frame of reference placed in the center of the ball. In this case the liquid at a distance from the ball will move with the speed $V=V_p-V_b$. Admitting the hit by liquid being ideally elastic, the amount of liquid effected the area AB during time Δt is:

$$\rho_M \cdot V_A \cdot \Delta t \cdot dr \cdot 2\pi r$$

where: $\rho_M$—specific gravity of the gas-liquid flow. Momentum of force produced by this amount of liquid is:

$$V_A \cdot (V_A \cdot \Delta t \cdot dr \cdot 2\pi r \cdot \rho_M)$$

As it follows from the FIG. 3 when liquid hits the ball only part of momentum is transferred to it, which is equal to:

$$2V_A \cdot \sin\alpha \cdot (V_A \cdot \Delta t \cdot dr \cdot 2\pi r \cdot \rho_M)$$

Due to spherical symmetry the part of this momentum is compensated and therefore the remaining momentum is equal to:

$$2(V_A \cdot \Delta t \cdot dr \cdot 2\pi r \cdot \rho_M) V_A \cdot \sin\alpha \cdot \sin\alpha = 2V_A^2 \cdot \Delta t \cdot dr \cdot 2\pi r \cdot \rho_M \left(1 - \frac{r^2}{R^2}\right)$$

where R—radius of the ball.

Admitting that only that liquid in the tubing is subjected to accelerating and transfers momentum of force to the ball which is contained within a cylinder with a radius equal to the radius of the ball, the value of $V_A$ can be determined from this equation:

$$(\pi R_T^2 - \pi r^2) V_A = \pi R^2 V$$

Thus $$V_A = \frac{V\pi R^2}{\pi(R_T^2 - r^2)} = \frac{VR^2}{R_T^2 - r^2}$$

So the momentum of force transferred by liquid during time Δt equates to:

$$F\Delta t = 2\left(\frac{VR^2}{R_T^2 - r^2}\right)^2 \Delta t \cdot dr \cdot 2\pi R \cdot \rho_M \left(1 - \frac{r^2}{R^2}\right)$$

Taking an integral by r from 0 to R, a total liquid head acting on the ball can be derived:

$$F = \int_0^R 2\left(\frac{VR^2}{R_T^2 - r^2}\right)^2 2\pi r \cdot \rho_M \left(1 - \frac{r^2}{R^2}\right) dr = 2\frac{V^2 R^4}{R^2} \pi \rho_M \int_0^R 2\frac{R^2 - r^2}{R_T^2 - r^2} r \cdot dr = 4\pi \cdot \rho_{CM} \cdot V^2 \cdot R^2 \left\{ \ln\left[\frac{1}{1 - \left(\frac{R}{R_T}\right)^2}\right] - \frac{R^2}{R_T^2} \right\}$$

To suspend the ball in the flow the liquid drive force F and weight of the ball G must be equal:

$$G = \frac{4}{3}\pi R^3 (\rho - \rho_M) g = F$$

where ρ—specific gravity of the ball, g—acceleration of gravity.

$$4\pi \cdot \rho_M \cdot V^2 R^2 \left\{ \ln\left[\frac{1}{1 - \left(\frac{R}{R_T}\right)^2}\right] - \frac{R^2}{R_T^2} \right\} = \frac{4}{3}\pi R^3 (\rho - \rho_M) g$$

Reducing the equation:

$$\rho_M \cdot V^2 \left\{ \ln\left[\frac{1}{1 - \left(\frac{R}{R_T}\right)^2}\right] - \frac{R^2}{R_T^2} \right\} = \frac{1}{3} R(\rho - \rho_M) g$$

Then one can determine a speed of the flow required to suspend the ball:

$$V = \sqrt{\frac{R \cdot g \cdot (\rho - \rho_M)}{3\rho_M \left\{ \ln\left[ \frac{1}{1 - \left(\frac{R}{R_T}\right)^2} \right] - \frac{R^2}{R_T^2} \right\}}}$$

The effect resulting from forming of a slugged structure of a gas-liquid flow due to the present invention comprises the following:

a) When flowing around the ball a zone with reduced pressure (decompression cavity) behind it is formed as shown in the FIG. 4. The gas runs into this zone while the liquid moves along the tubing wall. As a result of it a gas slug is formed behind the ball.

b) Above the gas slug the liquid draining down along the tubing wall forms a liquid slug.

c) The transverse oscillations of the ball ensure the separation of the gas slug (bubble) and simultaneously speed up formation of the liquid slug due to vibration of the tubing wall.

d) Oscillations of the ball and the tube at frequencies of about 1500–2000 Hz greatly enhance gas separation (releasing of gas from liquid).

The device is to be mounted into the lift tubing string as a single unit or a number of units. Number of units is determined from hydrodynamic calculations accounting the particular data on each well to be provided by the customer. Possible designs of a system of units are shown in FIGS. 2 and 5. From these figures it follows that system of units according to this invention can be either stationary (when the seats are rigidly fastened at the tubing pipes joints) or suspended, for example, on a wireline or rod. The installation layout of the units along the tubing string is determined after performing of special calculations.

To enable operation of the device and select diameter and weight of the ball a calculation of a minimal gas-liquid flow speed in the tubing string of a given diameter shall be firstly performed pursuant the equation derived above and accounting some corrections.

Let consider an example of a lift tubing string consisting of tubes with diameter d=73 mm. Assuming $\rho$=7.8 gm/cub.cm and $\rho_M$=0.4 gm/cub.cm, g=980 cm/sec$^2$, R=3 cm, $R_T$=3.2 cm one can obtain: V=1.2 m/sec.

The lift assembly equipped with a system of units comprising the float valves as shown in the FIG. 2 can be referred to by the nature of action they produce as a trap gaslift.

One can mark the following main advantages of the trap gaslift comparing the standard one:

1) One of the trap lift main advantages is that in emergency case of loss of pressure at well mouth or gas blow-by or strong variation of regime of lifting from the given one which is accompanied with an abrupt increasing of the flow, the ball valves installed in the lift tubing string will work as the normal valves and automatically shut the well;

2) In contrast to the standard lift the trap lift produces gas separation (separation of gas from oil) immediately as the flow moves along the lift tubing string what practically makes unnecessary the use of a gas trap (gas separator) at the outlet of the well;

3) Reduction of gas consumption eventually makes possible to extend the flowing period of a productive object because during standard lifting practices most of oil gas is wasted what results in faster loss of rock pressure and, correspondingly, stop of free flowing of the well.

SECOND EMBODIMENT OF THE INVENTION

Another embodiment of the proposed device is shown in the FIG. 5 and it works as follows. A gas-liquid flow running from the bottom hole to the mouth of a well flows around the beads (6) behind which the gas slugs (gas bubbles) (9) are formed, and liquid, for example the oil, draining down along the tubing wall (1) forms liquid slugs (10) and thus a system of alternating gas and liquid slugs is formed which is optimal from a point of view of effectiveness of gas consumption and lifting of the liquid. When the beads move counterflow with acceleration and simultaneously a "flooding", i.e. formation of the liquid slugs, takes place, the effect of concentrating of the dispersed gas into gas slugs (bubbles) greatly increases. To provide it the travel of a bead (6) up (due to big gas bubbles) and down (due to weight) takes place between two neighbor stoppers (7).

When spontaneously formed gas or liquid slugs flow around a bead the bead will reciprocally move in axial direction.

When a bead is flowed around by a gas-liquid (bubbling) mixture the bead will sink (move down) and transversely oscillate respectively the suspension support.

Big bubbles—gas slugs, when moving up and approaching the bead will have it to move up till it reaches the upper stopper of its motion. After that it will drop forming behind it new gas slugs if the flow below it is a bubbling mixture.

A layer of liquid draining down along the lift tubing wall also assists counterflow motion of a bead.

Formation of a regular slugged structure of the gas-liquid flow will take place in that intervals where either regime of bubbly flow or gas separation or a gas blast regime of flowing of gas along the axis of the lift tubing string take place.

Since when an oil and gas production well flows or fluid is produced by gas lift, usually one can observe in the lift tubing string (it was determined by laboratory studies) a chaotic motion of a gas-liquid flow, i.e. all kinds of flow (gas blast flow, plug flow, bubbly flow) present in it, the proposed system of spatially distributed beads will automatically form the regular slugging regime of motion only in zones where it is absent.

The beads perform three functions:

1. a bead being placed inside a lift tubing string is an obstacle for gas segregation in the axial zone of the tubing string and makes the gas bubbles go closer to the tubing wall and thus suppressing the effect of gas slip;
2. when the bead drops a decompression zone is formed behind it where gas bubbles are accumulated (diffusion of gas into decompression zone) thus forming a gas slug needed to form the slugged structure of the gas-liquid flow;
3. when moving up or down the bead oscillates due to its radial displacing and induces vibration of the tubing what amplifies effect of "flooding" and therefore improves formation of the slugged structure of gas-liquid flow.

Special importance of the system of beads in lift tubing string is that motion of the beads within interval of admitted travel from lower stopper to the upper one allow to maintain the gas slug in working regime thus keeping it away from transfer into regime of drift when it stops transporting a liquid slug up but just "spreads" it along the tubing wall.

In fact one obtains a self-adjusted system of the non-tight "free" plungers that is similar to the plunger lift, but in contrast to it, operating without "idle" runs.

Advantage of a system of beads is also that if necessary the suspension support can be lifted to surface using a winch to clean the lift tubing from gas-hydrate formations or paraffin depositions on tubes. In this case the beads will work as scrapers.

Opportunity to independently lift the system of beads has such an important advantage that in the lift tubing string thus made free of equipment inside the geophysical works and well logging can be carried out.

Let consider a following example of practical use of the proposed embodiment of the invention:

Into a well equipped with a uniform size lift tubing string made of tubing pipes a suspension support (wireline) is run on which in every 100 m the stoppers in form of the collars are fastened (variant of equidistant intervals of beads motion). Between the stoppers the beads are positioned in form of balls that are free stringed on the wireline and diameter of which is 6 mm less than inner diameter of the lift tubing. In a particular case, the weight of the bead is the same.

The suspension support is fixed at the mouth of a well and a plumb is provided on the bottom hole end of the wireline to stretch it. Then the well is operated in free flowing regime or regime of lifting of liquid due to natural or artificial gaslift.

Applicability in Industry

System of devices for operation of free flowing or gaslift oil wells which is mounted or placed in a standard lift tubing string allows to form a slugged regime of gas-liquid mixture motion (alternating of gas and liquid slugs). It ensures an efficient consumption of oil gas or injected compressed air what provides an opportunity to save the elastic energy accumulated in rock and to extend the period of free flowing of the productive object and increase oil recovery factor.

Besides, the exhausts of oil gases into atmosphere are pronouncedly reduced what improves the ecological situation at the territories by the oil production facilities.

Use of said devices also allows the following:

to increase daily production of oil by 20–25%;

to reduce water content in produced fluid;

to separate gas from oil immediately while the gas-liquid mixture lifts along the tubing string, what in some cases excludes using of a special gas separator on the surface.

In case of a suspension system of devices there is no need of lifting of the lift tubing string to the surface for cleaning it and disassembling of the devices to admit running into the well of geophysical instrumentation and formation testers.

What is claimed is:

1. Device for operating a free flowing or gaslift oil wells comprising a lift tubing string employed to lift liquid and gas, and a device for modifying of structure of a gas-liquid flow placed inside said tubing string wherein said device for modifying of structure of a gas-liquid flow is made in a form of, at least, one float ball valve where radius and weight of the ball are selected depending on speed of the gas-liquid flow in accordance with the following formulas:

$$V \geq \sqrt{\frac{R(\rho - \rho_M)g}{3\rho_M\left\{\ln\left[\frac{1}{1-\left(\frac{R}{R_T}\right)^2}\right] - \frac{R^2}{R_T^2}\right\}}},$$

$$G = \frac{4}{3}\cdot\pi R^3(\rho - \rho_M)\cdot g = F$$

where V—speed of gas-liquid flow, G—weight of a ball, F—flow drive force, R—radius of a ball, ρ—specific gravity of the ball, $\rho_M$—specific gravity of the gas-liquid mixture, g—acceleration of gravity, $R_T$—inner radius of tubes of a lift tubing string.

2. Device of claim 1, wherein diameter of the said ball constitutes 0.8–0.9 of inner diameter of tubes of said lift tubing string.

3. Device for operating a free flowing or gaslift oil wells comprising a lift tubing string employed to lift liquid and gas, and a device for modifying of structure of a gas-liquid flow placed inside said tubing string wherein said device for modifying of structure of a gas-liquid flow is made in a form of, at least, one element forming the structure of a gas-liquid flow which element is a bead which size ratio is $d_S/d_T \leqq 0.9$, where $d_S$ is a maximal diameter of the bead and $d_T$, is an inner diameter of the lift tubing string, and this bead is unboundedly stringed on a suspension support and placed along the lift tubing string with opportunity of radial and axial motion, and on the said suspension support from both sides of the said bead the stoppers are rigidly fixed.

4. Device of claim 3, wherein said suspension support is made in the form of a wireline.

5. Device of claim 3, wherein said suspension support is made in form of a rod assembly.

6. Device of claim 3, wherein said stoppers of axial motion of said beads are rigidly fixed on the suspension support with spacing intervals between them which are selected depending on a current level of gas content along the lift tubing string.

7. Device of claim 3, wherein said beads can be made of different geometrical shapes and from materials with the same or different specific gravity or different materials, and either solid or hollow or with a hollow filled with the liquids of same or different gravity.

* * * * *